US005720622A

United States Patent [19]

Ishikawa et al.

[11] Patent Number: 5,720,622

[45] Date of Patent: Feb. 24, 1998

[54] MEMBER FOR SECURING CONDUCTION AND CONNECTOR USING THE MEMBER

[75] Inventors: Shuhei Ishikawa, Handa; Naoki Sakamoto, Higashi-Ibaragi-gun, both of Japan

[73] Assignee: NGK Insulators, Ltd., Japan

[21] Appl. No.: 470,539

[22] Filed: Jun. 6, 1995

[30] Foreign Application Priority Data

Jan. 12, 1995 [JP] Japan ..... 7-003352

[51] Int. Cl.[6] ..... H01R 4/58

[52] U.S. Cl. ..... 439/86; 439/927

[58] Field of Search ..... 439/86, 91, 927, 439/90, 66

[56] References Cited

U.S. PATENT DOCUMENTS

| | | | |
|---|---|---|---|
| 3,636,501 | 1/1972 | Walsh | 439/86 X |
| 4,295,699 | 10/1981 | DuRocher | 439/86 |
| 4,754,546 | 7/1988 | Lee et al. | 439/86 X |
| 4,923,739 | 5/1990 | Jin et al. | 439/86 X |
| 5,033,675 | 7/1991 | Shino | 439/86 X |
| 5,340,318 | 8/1994 | Kunihiro | 439/91 X |
| 5,378,159 | 1/1995 | Renn | 439/66 X |
| 5,403,194 | 4/1995 | Yamazaki | 439/66 |
| 5,427,535 | 6/1995 | Sinclair | 439/66 |
| 5,453,027 | 9/1995 | Buell et al. | 439/927 |

FOREIGN PATENT DOCUMENTS

| | | |
|---|---|---|
| 51-8710 | 3/1976 | Japan . |
| 1-22230 | 6/1989 | Japan . |

*Primary Examiner*—Christopher McDonald
*Attorney, Agent, or Firm*—Parkhurst & Wendel

[57] ABSTRACT

A member for securing conduction for being placed between connecting elements of a connector has a sheet made of an insulating, elastic material and at least one conductive chip embedded in said sheet. The sheet is made electrically conductive between both surfaces by means of said at least one conductive chip. Since the member for securing conduction has a sheet made of an insulating, elastic material and at least one conductive chip embedded in the sheet, the member for securing conduction is applicable to both a flat conductive surface and a curved conductive surface. The member for securing conduction can easily correspond with various sizes of connectors and has a sufficient durability to be repeatedly used.

16 Claims, 4 Drawing Sheets

MEMBER FOR SECURING CONDUCTION AND CONNECTOR USING THE MEMBER

BACKGROUND OF THE INVENTION AND RELATED ART STATEMENT

The present invention relates to a member for securing and supporting conduction and a connector using the member. The member is used for connecting a conductor to another conductor. Each of the two conductors has a large capacity and is used for various kinds of electric appliances.

The member for securing and supporting conduction secures and supports electrical conduction between two connecting elements by placing the member between the connecting elements of a connector when a connecting element has distortion.

The connector electrically connects a conductor to another conductor, both of the conductors each having a large capacity. Each connecting element of a connector has a flat conductive face, and the faces are combined so as to ensure electrical conduction. In another connector, one of connecting elements is a plug and the other connecting element is a socket. The plug is mounted in a socket so that the outer surface of the plug contacts the inner surface of a hole of the socket, thereby ensuring the electrical conduction. In such a connector, the connecting elements need close contact with each other so as to ensure sufficient electrical conduction. However, when a connecting element is distorted or when the connector has dust between the connecting elements, the connecting area between the connecting elements becomes smaller, which hinders the close contact of the connecting elements, resulting in incomplete electrical conduction. In order to ensure the electrical conduction between the connecting elements, there has conventionally been used a protruded ting arranged in the inner surface of a socket, numerous needle-like springs arranged in the shape of an arc inside the hole of the socket, etc. However, even if the protruded ring is used, the entire circumference of the ring scarcely contacts with the outer surface of the plug, and therefore the ring is not effective in view of ensuring electrical conduction. Using needle-like springs is effective in electrical conduction. However, the method has some disadvantages that it costs a lot, that size of applicable connectors is limited, that the method is not suitable for a connector having a multipolar and coaxial structure because the inner diameter of a socket becomes large in comparison with a diameter of a plug, etc.

To solve the aforementioned problem, Japanese Utility Model Publication 1-22230 discloses a member having two ringed frames and a plurality of blades obliquely oriented to an outer surface of a plug, the blades being arranged at regular intervals between the two ringed frames. The member is fixed to the inner surface of a socket or the circumference of a plug. Japanese Utility Model Publication 51-8710 discloses a ringed member made of metal which has a plurality of cuts so as to have tongues. The both ends of each tongue are connected to the metallic band. The member is fixed to the inner surface of a socket or the outer surface of a plug, thereby orienting the tongues obliquely to the outer surface of a tongue.

However, the aforementioned members are used for a connector of a socket-and-plug type. Particularly, the member disclosed in Japanese Utility Model Publication 51-8710 is not applicable to a connector which connecting elements contact with each other by means of their flat surfaces. Moreover, both of the aforementioned members has such a problem of durability that repeated use of the members destroys or wears out the tongues or blades. Another problem is that a standard of a member has to be adjusted depending on the size of each connector.

SUMMARY OF THE INVENTION

One object of the present invention is to solve the aforementioned problems and provide a member for securing conduction, which is applicable to both a flat and a curved surface, which can easily correspond with various sizes of connectors, and which has sufficient durability for repeated use. Another object is to provide a connector using the member for securing conduction.

One aspect of the present invention provides a member for securing conduction, placed between connecting elements of a connector, comprising a sheet made of an insulating, elastic material; and at least one conductive chip embedded in the member, wherein the sheet is made electrically conductive between both surfaces by means of the at least one conductive chip.

In the aforementioned member for securing conduction, the at least one conductive chip is preferably embedded with a density of 0.2–200 chips/cm$^2$.

Preferably, a conductive chip partially protrudes from both surfaces of said sheet. An exposed portion of the conductive chip may be level with the surface. Preferably, the conductive chip is spherical and comprises beryllium copper.

The aforementioned insulating, elastic material is preferably made of rubber or resin. Further, the aforementioned conductive chip is preferably hollow.

Another aspect of the present invention provides a connector comprising two connecting elements, and a member for securing and supporting conduction comprising a member made of an insulating, elastic material, and at least one conductive chip embedded in the sheet, wherein the sheet is made electrically conductive between both surfaces by means of the aforementioned at least one conductive chip.

DETAILED DESCRIPTION OF THE INVENTION

A member for securing and supporting conduction of the present invention comprises a sheet made of an insulating, elastic material and at least one conductive chip embedded in the sheet.

A connector has mainly a flat or curved conductive surface. A connector of a socket-and-plug type represents connectors each having curved conductive surfaces. Both of the surfaces of each connector have microscopic distortion, and the area in which both connecting elements contact with each other is at most about 40% of the whole area of each conductive surface. When dust or the like is present on the conductive surface, the contact ratio further decreases, and electrical conduction becomes incomplete.

Figure 1:
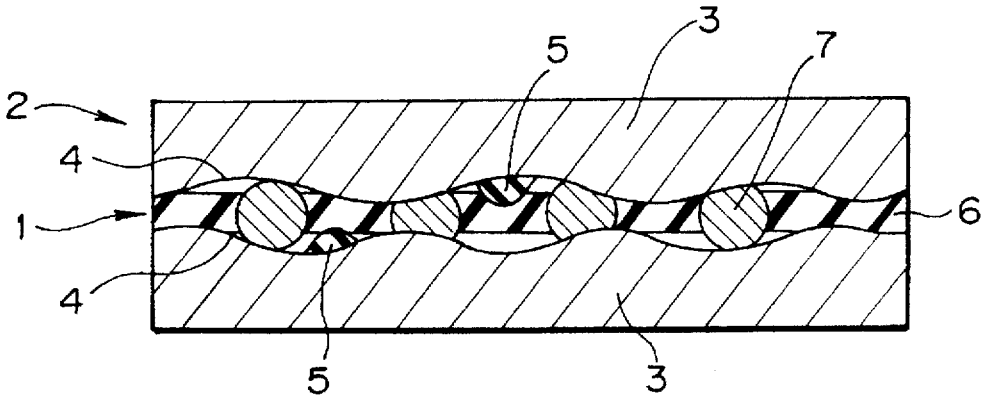
FIG. 1 is a typical illustration showing a function of a member for securing conduction of the present invention.

As shown in FIG. 1, the aforementioned material 1 for securing conduction is placed between connecting elements 3 of a connector 2, thereby effectively absorbing distortion of the conductive surfaces 4 and ensuring electrical conduction even if dust 5 or the like is present on the conductive surfaces 4.

The member for securing conduction preferably has a thickness of 0.1–2.0 ram, more preferably 0.3–1.5 min. When the member has a thickness of less than 0.1 ram, mechanical strength of the member decreases, causing a problem of durability, and effect of absorbing distortion of the conductive surface decreases, too. When the member has a thickness of more than 2.0 mm, it is prone to cause difficulty in attaching and detaching a plug to and from a socket.

A conductive chip preferably has a longer diameter of 0.01–1 mm, more preferably 0.1–0.8 mm. Preferably, the ratio of the longer diameter to the shorter diameter is less than 4. When the ratio is 4 or more, the chip has a slender shape, which makes the mechanical strength of the member for securing conduction low, and the slender chip is prone to break when the member for securing conduction is used for a curved surface.

A chip may have any configuration. However, preferably a chip does not have any corners and has a spherical configuration. When a chip has a corner, a corner portion protruding from the surface of the sheet has low durability, which affects durability of the member for securing conduction.

Conductive chips embedded in the sheet preferably have a density of 0.2–200 chips/cm$^2$, more preferably 2–100 chips/cm$^2$, furthermore preferably 10–50 chips/cm$^2$. When the density is less than 0.2 chip/cm$^2$, sufficient conduction is not ensured. When the density is more than 200 chips/cm$^2$, the member for securing conduction does not have sufficient elasticity because the ratio of an elastic material in the member for securing conduction is small. Such a member for securing conduction is not effective in absorbing distortion of a conductive surface of a connecting element and has a difficulty in being applied to a curved surface.

Figure 2A:
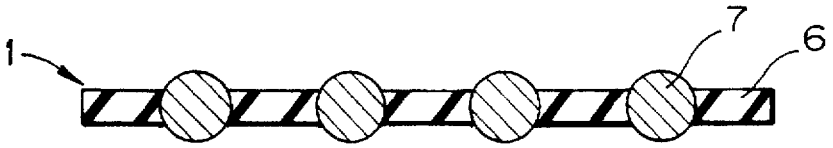
FIGS. 2A, 2B and 2C are typical illustrations showing embodiments of embedding conductive chips in an insulating sheet.

A conductive chip is preferably embedded in a sheet 6 so as to protrude from both surfaces of the sheet as shown in FIG. 2A. In this case, the sheet 6 is preferably thinner than a diameter of a conductive chips 7. Otherwise, some chips 7 may be completely embedded in sheet 6 or a portion of a chip protrudes from only one surface of the sheet 6, which is not preferable economically because such a chip does not work to ensure electrical conductivity.

Figure 2B:
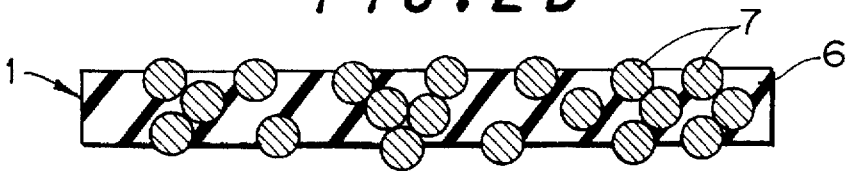

FIG. 2B shows a condition of chips 7 embedded in sheet 6 so that chips are in contact with each other in three-dimensions. Some of the chips 7 partially protrude from only one side of the sheet. This type of embedding chips are not preferable economically because some of the chips 7 which do not work to ensure electrical conduction are inevitably present.

Figure 2C:
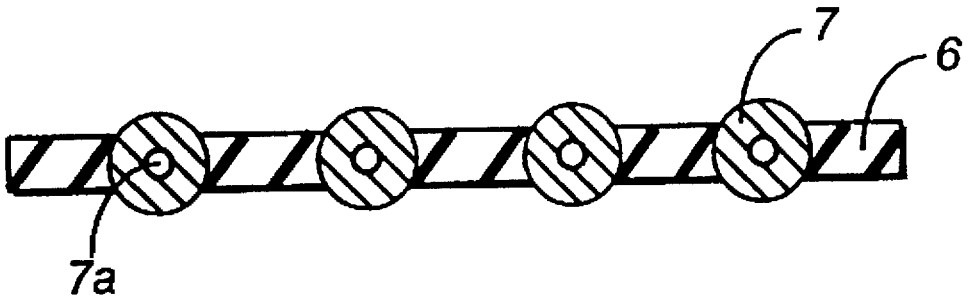

FIG. 2C shows an embodiment similar to that shown in FIG. 2A, but including hollow conductive chips. Each chip 7 includes a hollow portion 7*a*.

An arrangement that the conductive chips are level with a surface of the sheet is effective in abrasion resistance. The method for arranging chips to be level with a surface may be that a sheet in which conductive chips are protruding is prepared and then a protruding portion of each chip is sanded out so that chips are level with the surface of the sheet.

Since an elastic material is used for a sheet in a member for securing conduction of the present invention, the member can be applied to both flat and curved conductive surfaces of a connector. The elastic material needs to have a heat-resisting property, a weatherability, etc. There can be used rubber such as silicone rubber and synthetic rubber or resin such as polymer, polyimide, engineering resin. Particularly, a synthetic rubber such as styrene and butadiene rubber is suitably used as the elastic material.

A material for a conductive chip used in a member for securing conduction of the present invention needs to have abrasion resistance, plasticity, oxidation resistance, strength, etc., as well as conductivity. There can be preferably used phosphor bronze or the like, and particularly a beryllium copper is preferable.

Beryllium copper has sufficient conductivity, which is 20–60% of that of pure copper. Additionally, beryllium copper has a Vickers hardness of 250–400, while copper has a Vickers hardness of 80–100, which shows that beryllium copper has an excellent abrasion resistance. Further, beryllium copper has excellent plasticity, which is convenient to absorb distortion of connecting elements.

A beryllium copper used as a conductive chip in a material for securing conduction of the present invention preferably has a composition of copper as a main component, beryllium of 0.2–6.0 wt %, nickel and cobalt of 0.1–3.0 wt % totally, total amount of at least one element selected from aluminum, silicon, iron, titanium, tin, magnesium, manganese, zinc, and indium of 0.05–3.0 wt %, more preferably 1.6–2.0 wt %, 0.2–1.0 wt %, and 0.05–1.0 wt % respectively, and furthermore preferably 1.6–2.0 wt %, 0.2–0.6 wt %, and 0.05–1.0 wt % respectively.

A beryllium copper containing beryllium of 6.0 wt % or more is not preferable because conductivity decreases. Even if a beryllium content in a beryllium copper is increased to 2.0 wt % or more, the strength does not increase correspondingly, which is not economical. On the other hand, when a beryllium content in a beryllium copper is less than 0.2 wt %, strength of a conductive chip is not sufficient. When the total amount of nickel and cobalt is more than 3.0 wt %, conductivity of the conductive chip decreases. When the total of nickel and cobalt is less than 0.2 wt %, increase of the strength by adding beryllium is restrained, and a beryllium content has to be increased. Further, when the total amount of the other elements such as aluminum is more than 3.0 wt %, the conductivity decreases. When the total amount of the other elements is less than 0.05 wt %, the strength of the conductive chip is not sufficient particularly at high temperatures.

To improve flexibility of a conductive chip, a conductive chip may be hollow, as shown in FIG. 2C. In the case, the hollow portion is preferably 5–50% of total volume of a conductive chip, more preferably 10–40%, and furthermore preferably 20–30%. A thickness of a conductive chip is preferably 5–50% of a diameter of the hollow portion. The hollow portion preferably has a similar shape to the conductive chip.

Now, a method of producing a member for securing conduction of the present invention is described. A conductive chip is formed by a rotating electrode method using a material such as a beryllium copper for a conductive chip. Note that a rotating electrode method means a method for producing a metallic powder by scattering by centrifugal force a fusion generated by facing a fixed electrode, a electron beam, arc plasma, etc., to a metallic exhausted electrode and rapidly rotating the end surface of the exhausted electrode with dissolving the end surface.

The obtained chips of a beryllium copper are classified with sieves according to a particle size of each chip. Further the chips may be subjected to one or both of the following steps. One step is a lapping treatment for providing a uniform particle size. The other step is a surface treatment such as gold plating, Ni plating, Sn plating, or the like.

The chips of a beryllium copper produced as described above are mixed with an elastic material, and the mixture is formed to have a shape of a plate. Alternatively, the chips are disposed with a predetermined density, and then an elastic material is poured. Thus, a member for securing conduction of the present invention is produced.

A member for securing conduction of the present invention is disposed so that one surface of the member is in contact with a conductive surface of one connecting element of a connector and the other surface of the member is in contact with a conductive surface of the other connecting element. A conductive surface of a connecting element is pressed into contact with a member for securing conduction with a fastener of connector or the like so as to ensure conduction of the connector. A member for securing conduction of the present invention may be adhered to a conductive surface of one of the connecting elements. The member may be adhered with a conductive tape, or the like. As a conductive tape, a carbon tape is preferably used. Alternatively, the member may be mechanically adhered to a conductive surface of a connecting element by providing a holding portion having a shape of a hook, or the like. Alternatively, when conductive chips are relatively large and protrude from the surfaces of an elastic material, the conductive chips may be soldered so as to adhere the member for securing conduction to the conductive surfaces of the connecting elements.

Since a member for securing conduction of the present invention can be suitably cut in accordance with the size and configuration of a conductive surface of a connector, the member can easily correspond with various connector sizes.

EMBODIMENTS

The present invention is hereinbelow described in more detail with reference to illustrated Embodiments. However, the present invention is by no means limited to the embodiments.

FIGS. 3–7 shows embodiments of the aforementioned member for securing conduction applied to a connector.

Figure 3:
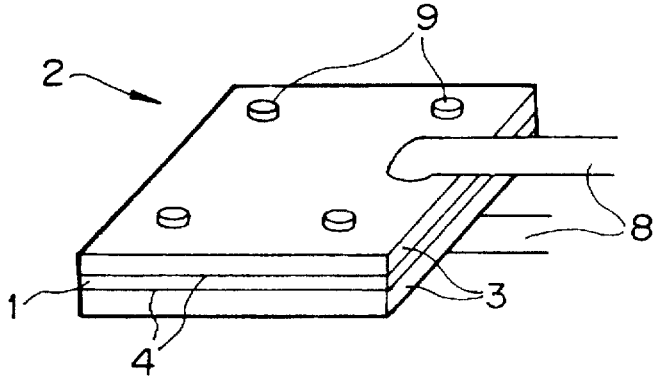
FIG. 3 is a perspective view showing an embodiment of a connector of the present invention using the aforementioned member for securing conduction.

In a connector 2 shown in FIG. 3, two planar connecting elements 3 to which cables 8 are connected am fixed with a fastener 9 comprising a bolt and a nut, etc., in a state that a conductive face 4 of each element 3 faces each other. This type of connector is used for a high-voltage current, for example, for connecting cables in a transforming appliance, a town, and a building. A member for securing conduction 1 is placed between conductive surfaces of two connecting elements 3. The member for securing conduction 1 may be adhered to one of the conductive surfaces. The member for securing conduction 1 is pressed into contact with conductive surfaces 4 by fixing two connecting elements 3 with a fastener 9. In the case of the connector shown in FIG. 3, distortion of conductive surfaces 4 is absorbed by an elasticity of a member for securing conduction 1 so that electrical conduction is ensured. Though a member for securing conduction 1 need not cover the whole conductive surface 4, the member 1 preferably covers as much area of the surface 4 as possible.

Figure 4:
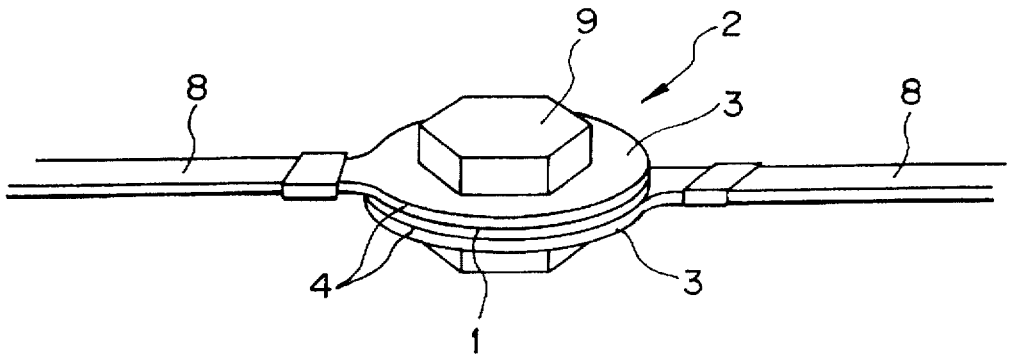
FIG. 4 is a perspective view showing another embodiment of a connector of the present invention using the aforementioned member for securing conduction.

A connector 2 shown in FIG. 4 has two ringed connecting elements 3. Conductive surfaces 4 of the connecting elements 3 face each other and are fixed with a fastener 9 which passes through a throughhole provided in the center of the ringed connecting elements 3. This type of connector has plenty of uses, connecting electric wires from 100V to a high-voltage current. A member for securing conduction 1 obtained by cutting in a ringed shape is placed between conductive surfaces of connecting elements 3. A member for securing conduction 1 may be adhered to one of the conductive surfaces. The member 1 is pressed into contact with conductive surfaces 4 by a fastener 9. Distortion of conductive surfaces 4 is absorbed by elasticity of the member for securing conduction 1, and an electrical conduction is ensured. Though a member for securing conduction 1 need not cover the whole conductive surface 4, preferably the member 1 covers as much area of the surface 4 as possible.

Figure 5:
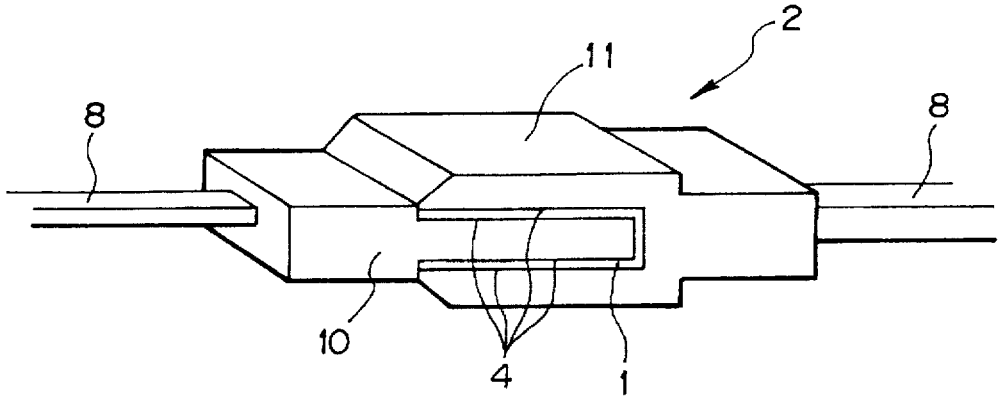
FIG. 5 is a perspective view showing still another embodiment of a connector of the present invention using the aforementioned member for securing conduction.

A connector 2 shown in FIG. 5 is a kind of a socket-and-plug type. A plug 10 having a protruded shape matching with a shape of a socket 11 is inserted into a depression of the socket 11 having a shape of a tuning fork. In this connector, the protruded portion of the plug 10 is nipped at the top and bottom by the socket 11, thereby fixing the socket 11 and the plug 10 mutually. This type of connector has plenty of uses like a connector in FIG. 4. The connector can be used for connecting cables having a capacity ranging from a several amps to an amperage over 1000 A. The connector has a characteristic that the connector can be attached and detached. A member for securing conduction 1 is suitably cut and placed between conductive surfaces of the connecting element so as to ensure electrical conductivity. The member for securing conduction 1 may be adhered to a conductive surface 4 of a socket 11 or a plug 10. The member for securing conduction 1 is pressed into contact with a conductive surface 4. Distortion of conductive surface 4 is absorbed by elasticity of the member for securing conduction 1, thereby ensuring electrical conductivity.

Figure 6:
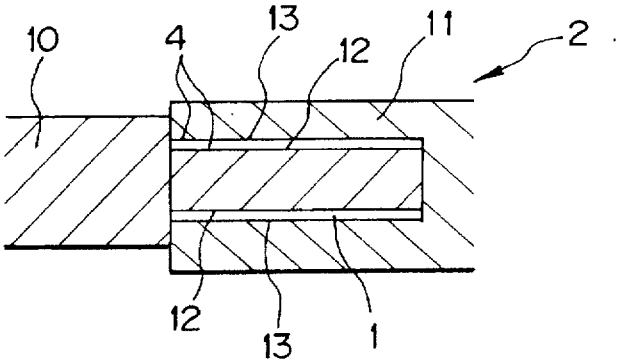
FIG. 6 is a typical illustration showing yet another embodiment of a connector of the present invention using the aforementioned member for securing conduction.

A connector 2 in FIG. 6 comprises a plug 10 having a cylindrical shape and a socket 11 having a cylindrical depression matching with a shape of a plug 10. In this connector 2, the inner surface 13 of the socket 11 constricts the outer surface 12 of a plug 10 and thereby the socket 11 and the plug 10 are mutually fixed. This type of connector has plenty of uses like the connectors shown in FIGS. 3 and 4. Preferably, the member for securing conduction 1 adheres to the outer surface 12 of the plug 10 or the inner surface 13 of the socket 11. The member for securing conduction 1 is pressed into contact with the conductive surfaces 4 by the force of socket 11 which constricts the periphery of the plug 10. Distortion of the conductive surfaces 4 is absorbed by elasticity of the member for securing conduction 1, thereby ensuring electrical conductivity.

Figure 7:
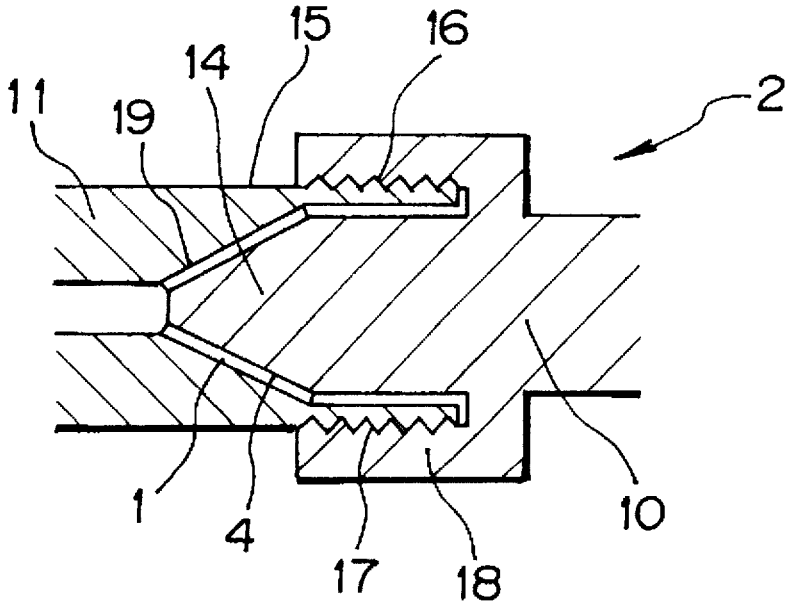
FIG. 7 is a typical illustration showing yet another embodiment of a connector of the present invention using the aforementioned member for securing conduction.

A connector 2 shown in FIG. 7 is a connector of so-called lock-nut type. A tip portion of plug 10 has a conical or frusto-conical shape, and is inserted into a depressed portion, matching with the shape of the plug 10, of a socket 11 so as to ensure electrical conduction. The socket 11 has a male screw portion on the outer surface 15, and the plug portion has a female screw portion 17 on the inner surface of a cylindrical portion 18. The plug 10 is connected with the socket 11 by threaded engagement. This type of connector has the uses similar to those of the connectors in FIGS. 3 and 4. The connector is also used for connecting cables of machines and tools or for hanging down a heavy cable, which need to avoid detaching. When the member for securing conduction 1 is used for this type of connector, the member 1 is preferably placed in a conical or frusto-conical portion of the tip portion 14 of the plug 10. Distortion on the conductive surfaces 4 and 19 is effectively absorbed by a force of pressing the conductive surface 19 of the socket 11 at the tip portion 14 of the plug 10 toward the tip portion. The member for securing conduction 1 is preferably adhered to the conductive surface 19 of the socket 11, corresponding to the tip portion 14 of a plug 10.

A member for securing conduction of the present invention comprises a sheet made of an insulating, elastic material and at least one conductive chip embedded in the sheet. Therefore, the member for securing conduction of the present invention is applicable to both a flat conductive surface and a curved conductive surface. Further, the member for securing conduction can easily correspond with various sizes of connectors and has sufficient durability to be repeatedly used.

What is claimed is:

1. A member for securing conduction between connecting elements of a connector, comprising:

a sheet comprised of an insulating, elastic material, said sheet having two opposite major surfaces; and a plurality of hollow conductive chips embedded in said sheet with a density of 0.2–200 chips/cm$^2$, whereby said sheet is made electrically conductive between both major surfaces by at least a single one of said plurality of conductive chips.

2. A member for securing conduction according to claim 1, wherein said at least one conductive chip partially protrudes from both surfaces of said sheet.

3. A member for securing conduction according to claim 2, wherein said at least conductive chip is spherical.

4. A member for securing conduction according to claim 1, wherein an exposed portion of said at least one conductive chip is level with a respective opposite major surface of the sheet.

5. A member for securing conduction according to claim 1, wherein said at least one conductive chip comprises beryllium copper.

6. A member for securing conduction according claim 1, wherein said insulating, elastic material is formed of rubber.

7. A member for securing conduction according to claim 1, wherein said insulating, elastic material is formed of resin.

8. A connector comprising:

two conducting elements; and a member for securing conduction between the connecting elements, comprising (i) a sheet comprised of an insulating, elastic material, said sheet having two opposite major surfaces; and (ii) a plurality of hollow conductive chips embedded in said sheet with a density of 0.2–200 chips/cm$^2$, whereby said sheet is made electrically conductive between both major surfaces by at least a single one of said plurality of conductive chips.

9. A connector according to claim 8, wherein each of the connecting elements has a conductive surface and is plate-shaped, the connecting elements being secured together by at least one fastener such that the conductive surfaces face each other.

10. A connector according to claim 8, wherein the connector is rectangular and includes a through hole extending through each corner thereof, wherein the connecting elements and the member for securing conduction are held together by bolts extending through respective through holes, each bolt receiving a nut.

11. A connector according to claim 8, wherein the connector is square.

12. A connector according to claim 8, wherein the connector is ring-shaped and includes a through hole extending therethrough that receives a bolt and nut for securing the two connecting elements and the member for securing conduction together.

13. A connector according to claim 8, wherein one of the connecting elements is a socket, and the other of said connecting elements is a plug, the socket having the shape of a tuning fork that forms a cavity, and the plug having an extension that corresponds to the shape of the cavity of the socket.

14. A connector according to claim 8, wherein one of the connecting elements comprises a socket, and the other of the connecting elements comprises a plug, the plug having a cylindrical shape, and the socket having a depression corresponding to the shape of the plug.

15. A connector according to claim 8, wherein one of connecting elements is a socket, and the other of the connecting elements is a plug, said plug including a tip portion that has a conical shape, and the socket having a depression corresponding to the shape of the plug.

16. A connector according to claim 8, wherein one of connecting elements is a socket, and the other of the connecting elements is a plug, said plug including a tip portion that has a frusto-conical shape, and the socket having a depression corresponding to the shape of the plug.

* * * * *